United States Patent [19]

Hooser

[11] Patent Number: 4,858,247

[45] Date of Patent: Aug. 22, 1989

[54] CAP SHAPE SUPPORTS

[76] Inventor: Donald L. Hooser, 1599-½ Hillcrest Rd., Fairmont, W. Va. 26554

[21] Appl. No.: 145,548

[22] Filed: Jan. 19, 1988

[51] Int. Cl.[4] ..... A42B 1/02

[52] U.S. Cl. ..... 2/185 B; 2/180

[58] Field of Search ..... 2/180, 195, 185 B, 197, 2/182.6

[56] References Cited

U.S. PATENT DOCUMENTS

| | | | |
|---|---|---|---|
| 2,681,451 | 6/1954 | Lipschutz | 2/185 B |
| 3,164,842 | 1/1965 | Weinstein | 2/195 |
| 3,482,266 | 12/1969 | Wagner | 2/180 |
| 3,548,416 | 12/1970 | Bloom et al. | 2/180 |
| 4,131,953 | 11/1979 | Kimotsuki | 2/182.6 X |
| 4,390,998 | 7/1983 | Gallin | 2/180 |
| 4,481,681 | 11/1984 | Hankin | 2/197 |

*Primary Examiner*—Peter Nerbun
*Attorney, Agent, or Firm*—Leon Gilden

[57] ABSTRACT

Several embodiments of cap shape retaining supports are designed to be removably positioned within recently washed caps. The supports serve to maintain a desired cap shape while the particular cap drys.

1 Claim, 2 Drawing Sheets

CAP SHAPE SUPPORTS

BACKGROUND OF THE INVENTION

1. Field of the Invention

The present invention relates to head covering apparel, and more particularly pertains to several embodiments of new and improved shape retainers for caps.

2. Description of the Prior Art

The use of reinforcing structures for visor caps, such as the type worn by sportsmen, baseball players, and the like, is well known in the prior art. As can be appreciated, quite frequently visor caps are constructed without adequate stiffening so that after they have been worn for some time, their appearance is degraded due to structural deformation and sagging. The problem of cap sagging is even further evident when such caps are laundered or dry cleaned and in many cases, circular stiffening material built into the cap crowns experiences substantial deformation during such cleaning operations. As such, there has been a number of attempts to develop either removable or permanently attached stiffening structures designed to overcome the problem of structural degradation resulting from cap washing.

For example, U.S. Pat. No. 2,681,451, which issued to E. Lipschutz on June 22, 1954, discloses a cap reinforcement structure which is designed to be either removably or permanently installed within a visor cap. The Lipschutz reinforcing frame includes a topmost circular ring and a lowermost semicircular ring interconnected thereto by a plurality of cross-extending pivotally interconnected support members. The entire structure is formed from plastic, and the top circular ring is adjustable in diameter to accommodate a conforming fit within a chosen cap. While being separate from the cap at the time of installation, the Lipschutz reinforcement frame in its preferred embodiment is designed to be permanently retained within the cap after installation and can be retained in the cap during a laundering or cleaning process. If any cap deformation or sagging occurs, the topmost circular ring can be adjustably expanded in diameter to offset cap structure deformation.

While being functional for its intended purpose, the Lipschutz reinforcement frame is substantially complex from a manufacturing standpoint due to the necessity of effecting a pivotal attachment of the cross-extending structural members. Further, the frame structure is difficult to remove from the cap once assembled and may in some cases lack sufficient structural strength to offset cap deformation.

As such, there appears to be a continuing need for new and improved cap reinforcement and shape retaining structures which could be easily attached within an interior portion of a cap while possessing sufficient structural strength to obtain or maintain cap shape after laundering. Further, such a reinforcement frame should be easily removable from the cap after laundering, if desired, and should also be manufactured in an inexpensive and efficient manner. In this regard, the present invention addresses this need.

SUMMARY OF THE INVENTION

In view of the foregoing disadvantages inherent in the known types of cap reinforcement structures now present in the prior art, the present invention provides several embodiments of improved cap shape retaining frames which may be easily adjusted in size within a cap to thus obtain a desired shape after laundering or cleaning, while such frames are also easily and inexpensively manufactured. As such, the general purpose of the present invention, which will be described subsequently in greater detail, is to provide new and improved cap reinforcing and shape retaining frames which have all the advantages of the prior art cap reinforcing and shape retaining frames and none of the disadvantages.

To attain this, a first embodiment of the present invention comprises a stamped or molded section of flat plastic which can be formed into a circle to conform to the interior shape of a cap. Suitable fastening means are provided for holding the desired circular shape of the reinforcing frame. Additionally, a forward portion of the circular frame includes an upwardly extending section designed to particularly support and shape the front of a baseball cap after laundering. In this regard, the frame structure possesses suitable structural rigidity to maintain cap shape after washing, i.e., during expected material deformation and shrinkage accompanying the drying process. The first embodiment of invention is desirably of an integral design, and various sizes could be manufactured to accommodate conventional and commercially available cap sizes.

A second embodiment of the invention addresses the use of a cap support and shape retaining frame which may be formed into a circle by suitable fastening means and which also has an adjustably movable forwardly positioned removable section. The removable section is designed to support the immediate front portion of a baseball cap during a drying process and can be adjusted upwardly relative to the circular frame structure so as to sufficiently tension and support the cap's front section. Suitable fasteners are provided to allow the adjustable movement of the cap front supporting section. More particularly, such fasteners could include integral plastic snaps which are frictionally resiliently engagable with apertures molded into respected parts of the cap supporting frame structure.

A third embodiment of the invention also envisions an adjustably removable cap front supporting section which is selectively attachable to the circular support ring structure with such attachment being accomplished by hook and loop fasteners. In this regard, the movable section includes a plurality of arm members slidably positionable within slots formed in the circular support section, and a removable sweat band is attachable across these arms members and within an interior peripheral portion of the support ring once the cap support structure has been positioned as desired within the cap's interior. As such, the sweat band functions both to hold the movable hat supporting section in a desired position while also providing comfort to the hat wearer. This third embodiment of the invention is designed to permit a person to wear his cap immediately after laundering and while the drying process is proceeding without any attendant discomfort being experienced.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cap support structure which has all the advantages of the prior art cap support structures and none of the disadvantages.

It is another object of the present invention to provide a new and improved cap support structure which may be easily and efficiently manufactured and marketed.

It is a further object of the present invention to provide a new and improved cap support structure which is of a durable and reliable construction.

An even further object of the present invention is to provide a new and improved cap support structure which is susceptible of a low cost of manufacture with regard to both materials and labor, and which accordingly is then susceptible of low prices of sale to the consuming public, thereby making such cap support structures economically available to the buying public.

Still yet another object of the present invention is to provide a new and improved cap support structure which provides in the apparatuses and methods of the prior art some of the advantages thereof, while simultaneously overcoming some of the disadvantages normally associated therewith.

Still another object of the present invention is to provide a new and improved cap support structure which is designed to be temporarily positioned within a baseball-type cap immediately after laundering, thereby to facilitate a retention of the desired cap shape.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
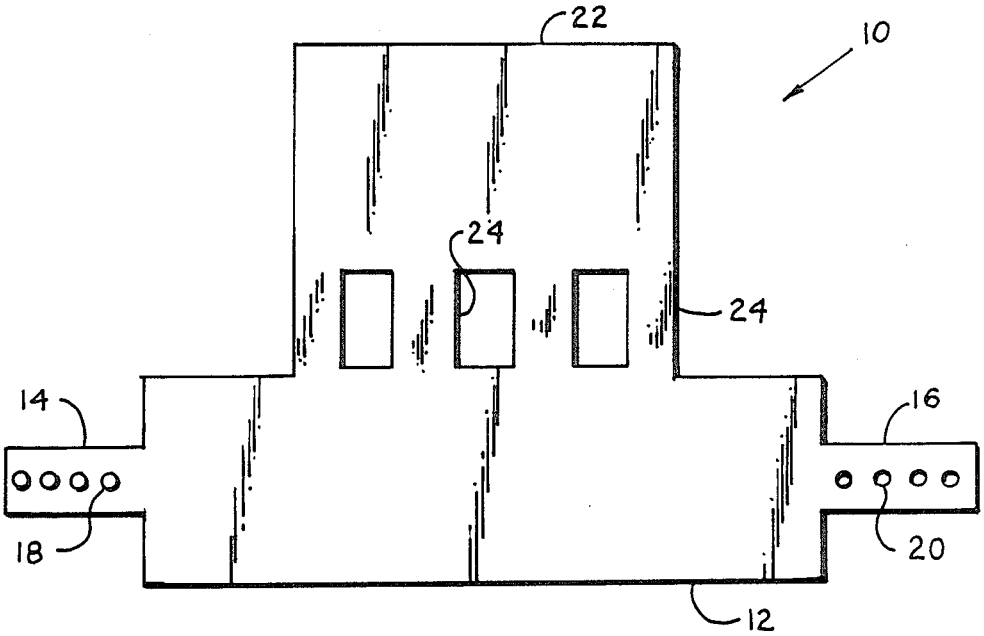
FIG. 1 is a top plan view of a first embodiment of the cap shape support structure forming the present invention.

With reference now to the drawings, and in particular to FIG. 1 thereof, a first embodiment of a new and improved cap shape support structure embodying the principles and concepts of the present invention and generally designated by the reference numeral 10 will be described.

More specifically, it will be noted that the first embodiment of the cap shape support structure 10 primarily consists of a section of resilient flat plastic 12 designed to be selectively formed into a ring shape within the interior portion of a baseball cap. In this regard, the flexible construction of the plastic member 12 allows it to be looped into the desired ring shape within the cap and to then be fastened into such shape by means of a pair of integral outwardly extending fastening straps 14, 16. The first strap 14 may include a plurality of through-extending apertures 18, and the connecting strap 16 may include a plurality of integral protuberances 20 which are frictionally resiliently engagable with selected ones of the apertures. Accordingly, a desired diameter can be acquired when the plastic member 12 is formed into a ring as a result of proper interconnecting of the straps 14, 16.

As further illustrated in FIG. 1, the rectangularly shaped plastic member 12 includes an integral upwardly extending rectangularly shaped member 22 which extends partially along a longitudinal length of the member 12. In this regard, the upwardly extending member 22 in interconnected to the member 12 by a plurality of cross-extending integral arms 24, and the member 22 serves to provide substantial rigid support to the front forwardly positioned material adjacent the visor of the baseball cap. Inasmuch as this first embodiment 10 of the invention is of an integral construction, various sizes thereof would have to be manufactured to accommodate various sizes of commercially available caps.

Figure 2:
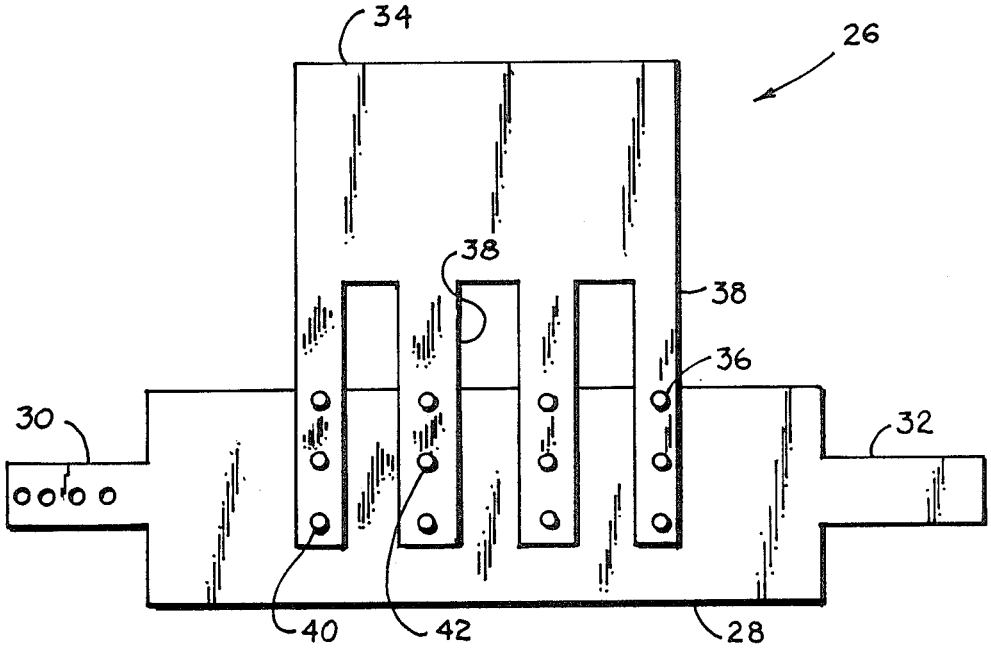
FIG. 2 is a top plan view of a second embodiment of the invention.

FIG. 2 of the drawings illustrates a modified embodiment of the invention which is generally designated by the reference numeral 26. As is apparent from reference to the drawing, the embodiment 26 of the invention includes a flexible plastic flat member 28 which may be selectively formed into a ring shape within an interior portion of a cap and fastened thereto by connecting straps 30, 32. The connecting straps 30, 32 may include similar fastening means to those illustrated in the embodiment 10 of the inventions; however, any conceivable and functional fastening means could be utilized provided that the functional purpose of the invention is achieved. Therefore, all conceivable and functional fastening means are within the intent and purview of the present invention.

A novel feature of the second embodiment 26 of the invention includes the adjustable attachment of the upwardly extending flexible plastic member 34, which serves to support the front material portion of a cap adjacent the cap's visor, to the support ring 28. As illustrated, the support member 34 is adjustably attachable to the member 28 through a plurality of functionally appropriate fasteners 36. More specifically, the member 34 could include a plurality of downwardly extending integral arms 38 each of which includes a plurality of through-extending apertures 40 which are selectively engagable with upwardly extending protuberances 42 integrally formed in the member 28. As such, when the embodiment 26 of the invention is positioned within a recently laundered cap, the member 34 may be adjustably positioned to support the front portion of the cap in a tensioned manner and can be lockably positioned relative to the member 28 through the use of the fastening means 36. This embodiment 26 of the invention can be removed from a cap after the cap has dried, and the cap is then ready to be worn by the user.

Figure 3:
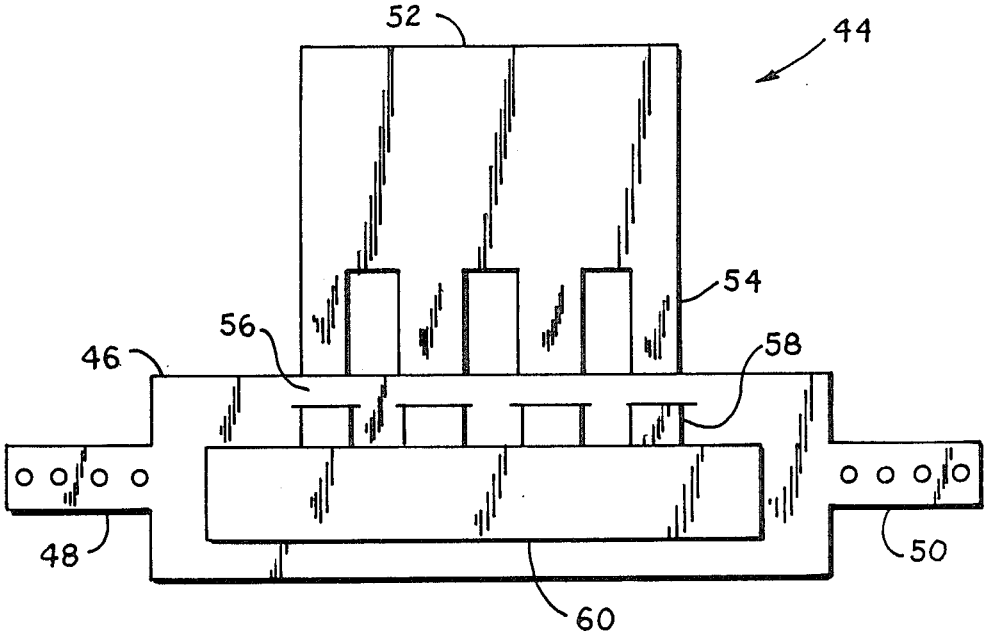
FIG. 3 is a top plan view of a third embodiment of the invention.
Figure 2:
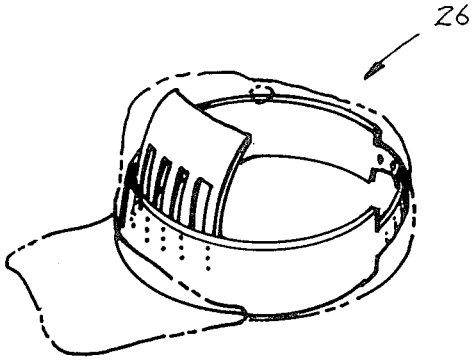

FIG. 3 of the drawings illustrates a further modified embodiment of the invention which is generally designated by the reference numeral 44. The embodiment 44 of the invention is designed to be inserted into a recently laundered cap so as to facilitate its drying in a desired configuration and shape, while also permitting a user to immediately wear the hat before the drying process is complete. More particularly, the embodiment 44 includes a flexible plastic section 46 which may be looped in a ring-like manner within an interior portion of the cap and fastened thereto by connecting straps 48, 50. The straps 48, 50 are similar in construction to the straps 18, 20 and 30, 32 illustrated in the respective previous embodiments 10, 26 of the invention. Similarly, a front cap supporting section 52 is adjustably positionable relative to the member 46. The member 52 includes a plurality of integral downwardly extending arms 54 which are slidably received through plastic loops 56 integrally or otherwise fixedly secured to the member 46. Inwardly facing surfaces 58 of the arms 54 include hook fasteners of the type commonly referred to as Velcro. Once the section 52 has been positioned as desired within a cap, a sweat band 60 having Velcro loop fasteners on an inward surface thereof is interconnected between the arms 54 in the manner illustrated in FIG. 3.

Accordingly, the front cap supporting section 52 is retained in a desired position so as to tension the cap material, while the sweat band 60 allows the cap to be immediately worn by a user before the drying process is complete. After the cap is dry, the embodiment 44 can be removed from the cap or if desired, it can be retained therein depending upon the wishes of the user.

With respect to the manner of usage and operation of the present invention, the same should be apparent from the above description. Accordingly, no further description of the manner of usage or operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cap shaped retaining structure comprising:

first support means selectively and adjustably formable into a closed loop within an interior peripheral portion of a cap;

first attachment means for holding said first support means in said closed loop, thereby to retain said cap in a conforming shape;

and second support means attached to said first support means, said second support means extending upwardly from said first support means when said first support means is positioned within said interior peripheral portion of said cap, said second support means serving to support a forward portion of said cap in said conforming shape, and wherein said second support means is removably attached to said first support means, and further including second attachment means, said second attachment means being utilized to attach said second support means to said first support means, and wherein said second support means includes a plurality of downwardly extending arms integrally attached thereto, said second attachment means forming a part of said downwardly extending arms, and wherein said downwardly extending arms are positionable through a plurality of loops formed on said first support means, and wherein said second attachment means comprises hook and loop fastening means, and further including sweat band means removably attachable around an inner peripheral portion of said first support means, said sweat band means also functioning as a part of said second attachment means.

* * * * *